US006505747B1

(12) United States Patent
Robertson

(10) Patent No.: US 6,505,747 B1
(45) Date of Patent: Jan. 14, 2003

(54) BOTTLE DISPLAY DEVICE WITH STACKABLE MODULES

(75) Inventor: James D. Robertson, Atlanta, GA (US)

(73) Assignee: Display Industries, LLC, Smyrna, GA (US)

( * ) Notice: Subject to any disclaimer, the term of this patent is extended or adjusted under 35 U.S.C. 154(b) by 0 days.

(21) Appl. No.: 09/933,509

(22) Filed: Aug. 20, 2001

(51) Int. Cl.[7] ..... A47F 7/00

(52) U.S. Cl. ..... 211/74; 211/194; 248/312.1; 248/314

(58) Field of Search ..... 211/74, 194, 77, 211/78; 248/312, 314, 312.1

(56) References Cited

U.S. PATENT DOCUMENTS 2,012,983 A * 9/1935 Bales ..... 211/74
2,318,081 A * 5/1943 Kerry
2,338,310 A * 1/1944 Barnes ..... 211/74
3,198,338 A * 8/1965 McCormick
3,554,384 A * 1/1971 De Natale
3,901,389 A * 8/1975 Delokin ..... 211/74
4,795,038 A * 1/1989 Johnson ..... 211/74
4,892,197 A * 1/1990 Slattery et al. ..... 211/194 X
4,915,239 A * 4/1990 Persch ..... 211/74
D405,293 S * 2/1999 Tate
6,209,733 B1 * 4/2001 Higgins et al. ..... 211/74

* cited by examiner

*Primary Examiner*—Robert W. Gibson, Jr.
(74) *Attorney, Agent, or Firm*—John L. James

(57) ABSTRACT

A display rack for holding bottles by the neck has stackable units with keyways for holding the bottles. Each unit has a vertically extending central hub with a horizontally extending flange attached thereto. A downwardly extending skirt is attached to the flange. The keyways are formed in the skirt alone or in the flange and skirt. An upper portion of each hub has a smaller dimension than a lower portion of the hub so that one unit may be stacked on top of another unit to accommodate a desired number of bottles.

19 Claims, 2 Drawing Sheets

BOTTLE DISPLAY DEVICE WITH STACKABLE MODULES

TECHNICAL FIELD OF THE INVENTION

This invention relates to a merchandising display for bottles, and, more particularly, to a rack for holding bottles by the neck.

BACKGROUND OF THE INVENTION

Display racks are useful for displaying bottles, especially beverage bottles, because a rack stacks many bottles using a limited amount of floor space which is always at a premium. Racks foster a neat display and allow one bottle to be removed without disturbing the other bottles. It is always desirable to have a rack that minimizes floor space, reduces manufacturing cost, or reduces transportation and storage costs. Contemporary display racks are typically stand alone units with fixed dimensions including a fixed height. Accordingly, it will be appreciated that it would be highly desirable to have a display rack whose height could be varied and could be easily transported and stored.

SUMMARY OF THE INVENTION

The present invention is directed to overcoming one or more of the problems set forth above. Briefly summarized, according to one aspect of the invention,. a merchandising display device for holding bottles by their necks comprises a vertically oriented hub, a flange attached to the hub and extending horizontally from the hub, and a skirt attached to the flange and extending downward from the flange with the skirt having a plurality of keyways adapted to receive and hold a bottle its neck. The hub, flange and skirt can be integrally formed as a module. Modules can be stacked one atop the other to a desired height. Individual modules are easy to handle and store requiring much less storage space than a complete rack.

According to another aspect of the invention, a modular display device for holding a plurality of bottles by necks of the bottles comprises first and second modules. The first module comprises a first hub having a vertically extending longitudinal axis. The first hub has an upper portion, a lower portion and a middle portion intermediate the upper and lower portions. A first flange is attached to the middle portion of the first hub and extends horizontally from the first hub. A first skirt is attached to the first flange and extends downward from the first flange. The first skirt has a plurality of keyways adapted to receive and hold a bottle by a neck of the bottle. The second module comprises a second hub having a vertically extending longitudinal axis. The second hub has an upper portion, a lower portion and a middle portion intermediate the upper and lower portions. A second flange is attached to the middle portion of the second hub and extends horizontally from the second hub. A second skirt is attached to the second flange and extends downward from the second flange. The second skirt has a plurality of keyways adapted to receive and hold a bottle by a neck of the bottle. The upper portion of the first hub is smaller in dimension than the lower portion of the second hub so that the second module can receive the first module to stack the modules one atop the other.

According to another aspect of the invention, a modular display device for holding a plurality of bottles by necks of the bottles comprises first and second modules. The first module comprises a first hub having a vertically extending longitudinal axis. The first hub has an upper portion, a lower portion and a middle portion intermediate the upper and lower portions. A first flange is attached to the middle portion of the first hub and extends horizontally from the first hub. A first skirt is attached to the first flange and extends downward from the first flange The first skirt has a plurality of upper openings each adapted to receive a bottle and a plurality of lower openings each adapted hold a bottle by a neck of the bottle. The second module comprises a second hub having a vertically extending longitudinal axis. The second hub has an upper portion, a lower portion and a middle portion intermediate the upper and lower portions. The upper portion of the first hub is smaller in dimension than the lower portion of the second hub so that the second module receives the first module to stack the modules one atop the other. A second flange is attached to the middle portion of the second hub and extends horizontally from the second hub. A second skirt is attached to the second flange and extends downward from the second flange. The second skirt has a plurality of upper openings each adapted to receive a bottle and a plurality of lower openings each adapted to hold a bottle by a neck of the bottle. Each of the upper openings of the first skirt mate with one of the lower openings of the second skirt to form a keyway adapted to receive and hold a bottle by a neck of the bottle.

The modules stack one atop the other to a desired height. Individual modules are easily stored using less space than a completely erected display rack. Each module can be molded and connected to one another without the need for other fasteners.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
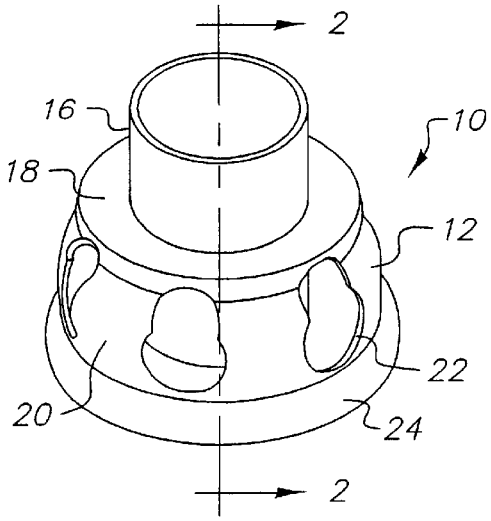
FIG. 1 is a perspective view of a preferred embodiment of a display module according to the present invention.
Figure 2:
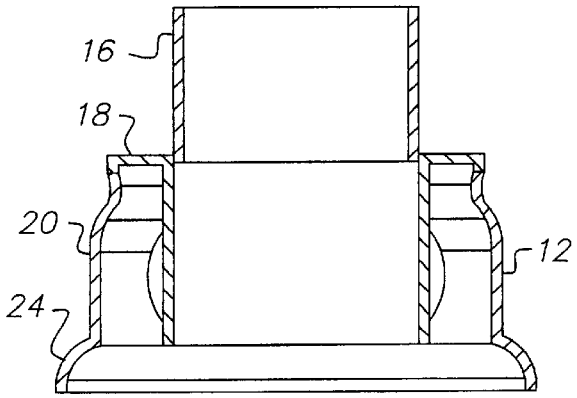
FIG. 2 is longitudinal sectional view of the display module of FIG. 1.
Figure 3:
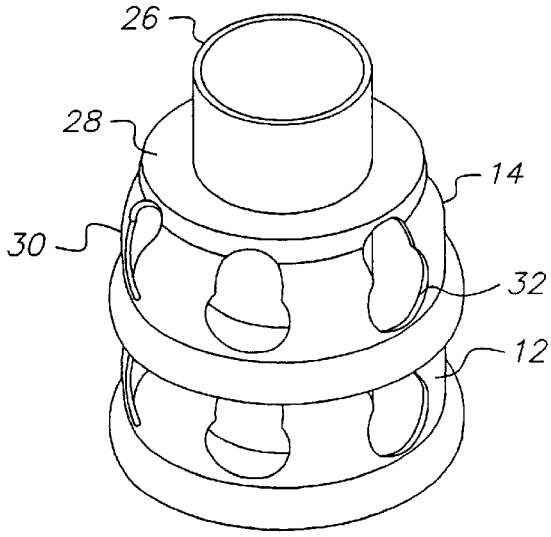
FIG. 3 illustrates a plurality of the display modules of FIG. 1 stacked one atop the other.

Referring to FIGS. 1–3, a modular display device 10 for holding a plurality of bottles by necks of the bottles has first and second display modules 12, 14 that are identical with one another. The first module 12 has a centrally located hub 16 with a vertically extending longitudinal axis. Hub 16 has an upper portion, a lower portion and a middle portion intermediate the upper and lower portions. A flange 18 is attached to the middle portion of the hub 16 and extends generally horizontally from the hub. A skirt 20 is attached to flange 18 and extends downward from the flange.

The skirt 20 has an upper portion and a lower portion with the upper portion extending downward from the flange 18 at an acute angle from horizontal and with the lower portion extending generally vertically downward from the upper portion. The upper portion of the skirt 20 extends a greater distance from the hub 16 than the flange 18. Preferably, the upper portion of the skirt attaches to a distal peripheral edge of the flange. The skirt may have a reinforced lower portion free of keyways. Preferably, there is a horizontally extending reinforcing rib 24 about a lower portion of the skirt forming a circumferential reinforcing band about the periphery of the skirt.

Skirt 20 has a plurality of keyways 22 adapted to receive and hold a bottle by a neck of the bottle. Each of the keyways 22 preferably has an arcuate upper portion and an arcuate lower portion that is larger in dimension than the upper portion. A generally straight intermediate portion may connect the upper and lower arcuate portions of the keyway 22. Such keyways are described more fully in U.S. Pat. No. 6,209,733. The disclosure of which is incorporated herein by reference.

The second module 14 has a centrally located hub 26 with a vertically extending longitudinal axis. Hub 26 has an upper portion, a lower portion and a middle portion intermediate the upper and lower portions. A flange 28 is attached to the middle portion of the hub 26 and extends generally horizontally from the hub. A skirt 30 is attached to flange 28 and extends downward from the flange. Skirt 30 has a plurality of keyways 32 adapted to receive and hold a bottle by a neck of the bottle. The upper portion of the bottom hub 16 is smaller in dimension than the lower portion of the top hub 26 so that the second, top module 14 receives the first, bottom module 12 to stack the modules one atop the other. The lower portion of the top hub 26 may rest on the bottom flange 18.

A display is formed using the modules by stacking one module atop the module below it until the desired height is reached. The lower portion of the hub of an upper module fits over the upper portion of the hub of the module below. The modules are rotated to stagger the keyways. Where the dimensions of the modules and height of the display dictates anchoring, a footing with an upwardly protruding hub to engage the hub of the bottom most module can be used, for example. The display can be similarly anchored at the top. Where the dimensions of the modules and height of the display are sufficient for stability, no anchoring or fastening of any type is required.

Figure 4:
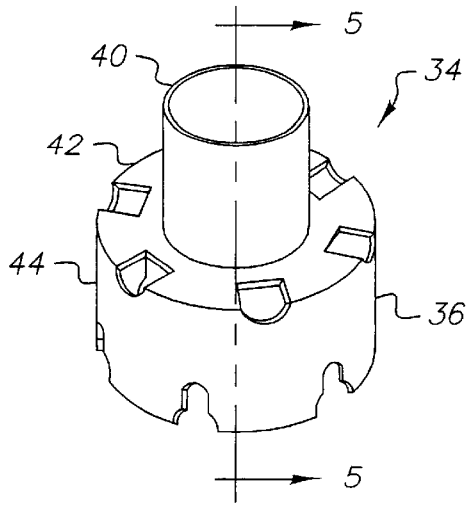
FIG. 4 is a perspective view of a display module similar to FIG. 1 but illustrating another preferred embodiment.
Figure 5:
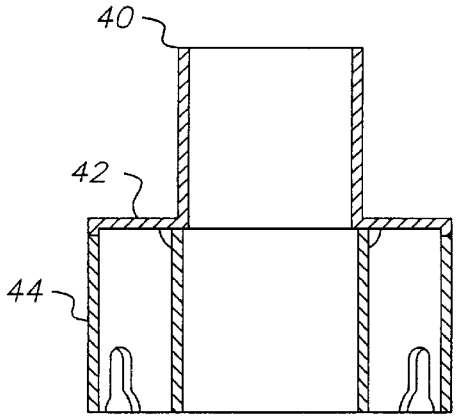
FIG. 5 is longitudinal sectional view of the display module of FIG. 4.
Figure 6:
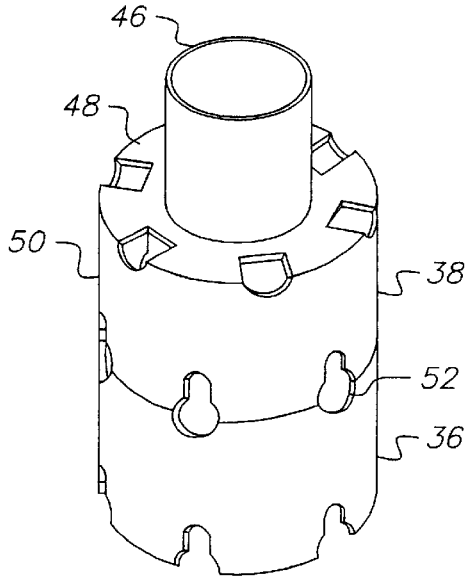
FIG. 6 illustrates a plurality of the display modules of FIG. 4 stacked one atop the other.

Referring to FIGS. 4–6, a modular display device 34 for holding a plurality of bottles by necks of the bottles has first and second display modules 36, 38 that are identical with one another and cooperate with one another to hold the bottles. The first, bottom module 36 has a centrally located hub 40 with a vertically extending longitudinal axis. Hub 40 has an upper portion, a lower portion and a middle portion intermediate the upper and lower portions.

A flange 42 is attached to the middle portion of the hub 40 and extends generally horizontally from the hub. Flange 42 defines a plurality of openings that are preferably equally spaced about the outer periphery of the flange. The openings can be in the form of a simple rectangle or square.

A skirt 44 is attached to flange 42 and extends downward from the flange. Skirt 44 has a plurality of upper openings each adapted to receive a neck of a bottle and a plurality of lower openings each adapted hold the bottle by the neck of the bottle. The upper and lower skirt openings are equal in number and number the same as the flange openings. Each upper skirt opening is associated with a flange opening so that they form a single opening. The upper and lower skirt openings are horizontally displaced from one another to stagger the openings about the skirt. Skirt 44 may extend downward a greater distance than the lower portion of the hub 40 so that module 36 may rest on skirt 44.

The second, top module 38 has a centrally located hub 46 with a vertically extending longitudinal axis. Hub 46 has an upper portion, a lower portion and a middle portion intermediate the upper and lower portions. The upper portion of the bottom hub 40 of the bottom module 36 is smaller in dimension than the lower portion of the top hub 46 of top module 38 so that the top module 38 can receive the bottom module 36 to stack the modules one atop the other. The lower portion of the hub 46 rests on the skirt 44 of the bottom module.

A flange 48 is attached to the middle portion of the hub 46 and extends generally horizontally from the hub. Flange 48 defines a plurality of openings that are preferably equally spaced about the outer periphery of the flange. The openings can be in the form of a simple rectangle or square.

A skirt 50 is attached to flange 48 and extends downward from the flange. Skirt 50 has a plurality of upper openings each adapted to receive a neck of a bottle and a plurality of lower openings each adapted hold the bottle by the neck of the bottle. The upper and lower skirt openings are equal in number and number the same as the flange openings. Each upper skirt opening is associated with a flange opening so that they form a single opening. The upper and lower skirt openings are horizontally displaced from one another to stagger the openings about the skirt.

Each of the upper openings of the skirt 44 of the bottom module 36 mate with a lower opening of the skirt 48 of the top module 38 to form a keyway 52 adapted to receive and hold a bottle by the neck of the bottle. Because the upper and lower openings of each module are staggered, the keyways are also staggered so that a bottle hanging from one key does not interfere with a bottle hanging from a keyway above or below it.

A display is formed using the modules by stacking one module atop the module below it until the desired height is reached. The lower portion of the hub of an upper module fits over the upper portion of the hub of the module below. The modules are rotated to align the top skirt openings of the lower module with the bottom skirt openings of the module above. This alignment automatically staggers the keyways.

It can now be appreciated that a merchandising display device for holding a plurality of bottles by their necks has been presented. The display device has a hub with a vertically extending longitudinal axis. A flange is attached to the hub and extends horizontally from the hub. A skirt is attached to the flange and extends downward from the flange. The skirt has a plurality of keyways adapted to receive and hold a bottle by a neck of the bottle. The hub, flange and skirt of each stackable module may be integrally formed of resinous material by injection molding or other fabrication technique. The modules join together to from a display of any needed height. Because the modules stack together, there is no need for mechanical fasteners. Because fasteners are not used, the modules are easily separated when it is desired to change the display. Depending on the physical dimensions of the modules, a display may stand alone without anchoring.

While the invention has been described with particular reference to the preferred embodiments, it will be understood by those skilled in the art that various changes may be made and equivalents may be substitued for elements of the preferred embodiments without departing from invention. While plastic is preferred, the modules could be formed of metal. It is accordingly intended that the claims shall cover all such modifications and applications as do not depart from the true spirit and scope of the invention.

What is claimed is:

1. A merchandising display device for holding a plurality of bottles, said device holding each bottle by a neck of said bottle, said display device, comprising:

a hub having a vertically extending longitudinal axis;

a flange attached to said hub and extending horizontally from said hub; and a skirt attached to said flange and extending downward from said flange, said skirt having a plurality of keyways adapted to receive and hold a bottle by a neck of said bottle, each of said keyways having an arcuate upper portion and an arcuate lower portion larger in dimension than said upper portion.

2. A merchandising display device, as set forth in claim 1, including a generally straight intermediate portion connecting said upper and lower arcuate portions.

3. A merchandising display device, as set forth in claim 1, wherein said skirt has an upper portion and a lower portion, said upper portion extending downward from said flange at an acute angle from horizontal, said lower portion extending vertically downward from said upper portion.

4. A merchandising display device, as set forth in claim 3, wherein said upper portion of said skirt extends a greater distance from said hub than said flange.

5. A merchandising display device for holding a plurality of bottles, said device holding each bottle by a neck of said bottle, said display device, comprising:

a hub having a vertically extending longitudinal axis;

a flange attached to said hub and extending horizontally from said hub; and a skirt attached to said flange and extending downward from said flange, said skirt having a plurality of keyways adapted to receive and hold a bottle by a neck of said bottle, said skirt having a reinforced lower portion free of keyways.

6. A merchandising display device, as set forth in claim 1, including a horizontally extending reinforcing rib about a lower portion of said skirt.

7. A modular display device for holding a plurality of bottles by necks of said bottles, comprising:

a first module, comprising:

a first hub having a vertically extending longitudinal axis, said first hub having an upper portion, a lower portion and a middle portion intermediate said upper and lower portions;

a first flange attached to said middle portion of said first hub and extending horizontally from said first hub; and a first skirt attached to said first flange and extending downward from said first flange, said first skirt having a plurality of keyways adapted to receive and hold a bottle by a neck of said bottle; and a second module, comprising:

a second hub having a vertically extending longitudinal axis, said second hub having an upper portion, a lower portion and a middle portion intermediate said upper and lower portions;

a second flange attached to said middle portion of said second hub and extending horizontally from said second hub; and a second skirt attached to said second flange and extending downward from said second flange, said second skirt having a plurality of keyways adapted to receive and hold a bottle by a neck of said bottle, said upper portion of said first hub being smaller in dimension than said lower portion of said second hub so that said second module receives said first module to stack said module one atop the other.

8. A modular display device, as set forth in claim 7, wherein each of said keyways has an arcuate upper portion and an arcuate lower portion larger in dimension than said upper portion.

9. A modular display device, as set forth in claim 8, including a generally straight intermediate portion connecting said upper and lower arcuate portions.

10. A modular display device, as set forth in claim 7, wherein each of said skirts has an upper portion and a lower portion, said upper portion extending downward from an associated flange at an acute angle from horizontal, said lower portion extending vertically downward from said upper portion.

11. A modular display device, as set forth in claim 10, wherein said upper portion extends a greater distance from an associated hub than said flange.

12. A modular display device, as set forth in claim 7, wherein said lower portion of said second hub rests on said first flange.

13. A modular display device for holding a plurality of bottles by necks of said bottles, comprising:

a first module, comprising:

a first hub having a vertically extending longitudinal axis, said first hub having an upper portion, a lower portion and a middle portion intermediate said upper and lower portions;

a first flange attached to said middle portion of said first hub and extending horizontally from said first hub; and a first skirt attached to said first flange and extending downward from said first flange, said first skirt having a plurality of upper openings each adapted to receive a bottle and a plurality of lower openings each adapted hold a bottle by a neck of the bottle; and a second module, comprising:

a second hub having a vertically extending longitudinal axis, said second hub having an upper portion, a lower portion and a middle portion intermediate said upper and lower portions, said upper portion of said first hub being smaller in dimension than said lower portion of said second hub so that said second module receives said first module to stack said modules one atop the other;

a second flange attached to said middle portion of said second hub and extending horizontally from said second hub; and a second skirt attached to said second flange and extending downward from said second flange, said second skirt having a plurality of upper openings each adapted to receive a bottle and a plurality of lower openings each adapted to hold a bottle by a neck of the bottle, each of said upper openings of said first skirt mating with one of said lower openings of said second skirt to form a keyway adapted to receive and hold a bottle by a neck of the bottle.

14. A modular display device, as set forth in claim 13, wherein said lower portion of said second hub rests on said first flange.

15. A modular display device, as set forth in claim 13, wherein said first flange defines a plurality of flange openings each associated with one of said upper openings of said first skirt.

16. A modular display device, as set forth in claim 15, wherein each said flange opening and its associated upper opening form a single opening.

17. A modular display device, as set forth in claim 13, wherein said upper and lower openings of said first skirt are horizontally displaced from one another to stagger said keyways so that a bottle hanging from one keyway does not interfere with a bottle hanging from a keyway above it.

18. A modular display device, as set forth in claim 13, wherein said first hub, first flange and first skirt are integrally formed.

19. A modular display device, as set forth in claim 13, wherein said skirt of said first module extends downward a greater distance than said lower portion of said first hub so that said first module can rest on said first skirt.

* * * * *